United States Patent [19]

Kassman et al.

[11] 4,294,265

[45] Oct. 13, 1981

[54] FILTER CIGARETTE WITH INLET VENT ZONES

[75] Inventors: Allen J. Kassman, Richmond; Willard A. Geiszler, Jr., Chesterfield, both of Va.

[73] Assignee: Philip Morris Incorporated, New York, N.Y.

[21] Appl. No.: 137,159

[22] Filed: Apr. 4, 1980

[51] Int. Cl.[3] ..... A24D 1/04; A24D 3/04

[52] U.S. Cl. ..... 131/366

[58] Field of Search ..... 131/10 A, 15 A, 15 B, 131/261 A, 198 R, 198 A

[56] References Cited

U.S. PATENT DOCUMENTS

| | | | |
|---|---|---|---|
| 2,988,088 | 6/1961 | Schur | 131/10 A |
| 3,596,663 | 8/1971 | Schultz | 131/10 A |
| 3,805,800 | 4/1974 | Summers | 131/10 A |
| 4,174,719 | 11/1979 | Martin et al. | 131/10 A |

FOREIGN PATENT DOCUMENTS

| | | | |
|---|---|---|---|
| 2209763 | 9/1972 | Fed. Rep. of Germany | 131/10 A |
| 2708873 | 9/1977 | Fed. Rep. of Germany | 131/10 A |
| 2206663 | 6/1974 | France | 131/10 A |
| 2001841 | 2/1979 | United Kingdom | 131/10 A |

*Primary Examiner*—V. Millin

*Attorney, Agent, or Firm*—Arthur I. Palmer, Jr.; Nelson A. Blish

[57] ABSTRACT

This invention relates to a filter cigarette having inlet vents in the filter mouthpiece divided into two groups. The distance between the two groups of inlet vents is selected to give an increased resistance to draw without appreciably decreasing dilution or total particulate matter.

9 Claims, 2 Drawing Figures

FILTER CIGARETTE WITH INLET VENT ZONES

BACKGROUND OF THE INVENTION

This invention relates generally to filter cigarettes, and more particularly to filter cigarettes with means for diluting the smoke with outside air.

DESCRIPTION OF THE PRIOR ART

The components of smoke from a conventional unfiltered cigarette may be divded into two general categories, the gas phase (GP) components and the total particulate matter (TPM) components. For a variety of reasons it is often desirable to reduce the concentration of tobacco smoke components in both of these categories. In general a filter medium is used to reduce TPM. However, the filter medium has little effect on GP components. A method of reducing GP components shown in the prior art is to dilute the cigarette smoke with outside air.

Ventilation into the filter for purposes of dilution is usually limited to a rather narrow zone. Norman, for example, U.S. Pat. No. 3,860,011, shows several circumferential rows of ventilation openings located at about the midsection of the filter. Hall, U.S. Pat. No. 4,034,765, also locates the inlet vents near the filter midpoint, but uses only a single circumferential row of perforations. DeSimone, U.S. Pat. No. 3,324,862, discloses a single row of inlet vents near the junction of the tobacco rod and filter. The DeSimone vents, however, pass air along rather than into the filter. Davis locates the inlet vents at either the tobacco rod and filter junction, U.S. Pat. No. 3,482,579, or at a point on the filter one-third the distance between the smoker's mouth and the tobacco rod, U.S. Pat. No. 3,590,825. Shur, U.S. Pat. No. 2,988,088, positions a single circumferential series of orifices in either the cigarette tobacco wrapper or at a fixed position in the filter tip.

Another method of dilution shown by the prior art is the use of unlocalized ventilation using porous paper wrapped around the filter plug. Tucker, U.S. Pat. No. 3,410,275, accomplishes ventilation by this method employing a porous plug wrap and leaving a portion of the porous plug wrap uncovered by the nonporous tipping paper. Summers, U.S. Pat. No. 3,924,643, uses a porous plug wrap and porous tipping paper to provide ventilation, the filter being unventilated only in those areas where the plug wrap and tipping paper are joined by adhesives. Thus the prior art shows inlet ventilation confined either to a narrow band or covering the entire filter mouthpiece or large regions of the filter mouthpiece.

As indicated above, dilution may be used in order to reduce GP components. However, as the amount of ventilation is increased, the resistance to draw (RTD) is decreased and may cause smoker frustration. A denser filter may be used to increase RTD, but this results in a higher filter.

SUMMARY OF THE INVENTION

According to the present invention, the foregoing and other objects are obtained by providing a filter cigarette with inlet vents divided into at least two groups, one group of inlet vents being separated from the other by a distance sufficient to increase RTD to a desired level without decreasing dilution or TPM.

BRIEF DESCRIPTION OF THE DRAWINGS

A more complete appreciation of the invention and many of the attendant advantages thereof will be readily apparent by reference to the following detailed description when considered in connection with the accompanying drawings wherein.

DESCRIPTION OF THE PREFERRED EMBODIMENT

Figure 1:
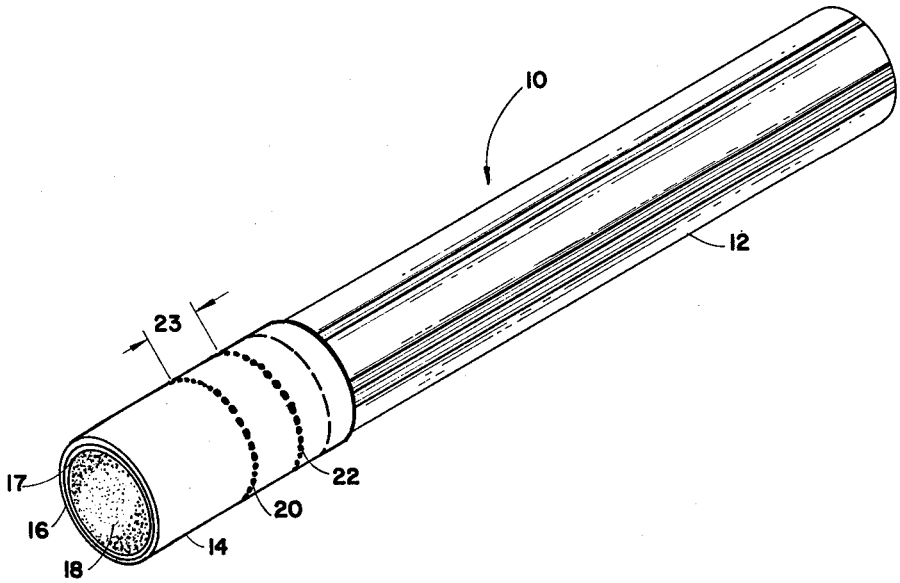
FIG. 1 is a perspective view of a cigarette having a filter mouthpiece made in accordance with the present invention.

Referring now more particularly to the drawings and specifically to FIG. 1, there is illustrated a preferred embodiment of the present invention as it would be used in a cigarette designated generally by reference numeral 10. The two major parts of cigarette 10 are a tobacco rod 12 and a filter mouthpiece 14.

The filter mouthpiece 14 consists of a filter medium 18, porous plug wrap 17, and tipping paper 16. Filter medium 18 is cylindrical in shape and substantially conforms to the cross sectional size and shape of tobacco rod 12. The filter medium 18 may be composed of any known filtering medium or combination thereof, but, in the preferred embodiment, the filter medium 18 is cellulose acetate. Filter medium 18 is covered with porous wrap 17.

The filter medium 18 abuts tobacco rod 12 and is attached to tobacco rod 12 in a conventional manner. In the preferred embodiment, filter medium 18 is attached to tobacco rod 12 by use of tipping paper 16. Tipping paper 16 is essentially air impervious.

Inlet vents 20 and 22, which allow outside air to pass through tipping paper 16, are divided into at least two groups, a first group 20 and a second group 22. Inlet vents 20 and 22 may be arranged in any convenient manner, but in the preferred embodiment are arranged in two circumferential rows of perforations. The first group of inlet vents 20 is separated from the second group of inlet vents 22 by a distance 23 sufficient to increase RTD to a higher value than if the first group of inlet vents 20 and the second group of inlet vents 22 were adjacent to each other. However, with inlet vents 20 and 22 separated by distance 23, dilution is approximately the same or higher than with inlet vents 20 and 22 adjacent to each other. This is demonstrated by the following experimental data.

EXPERIMENTAL RESULTS

Conventional unventilated filter cigarettes were provided with inlet ventilation at various distances along the filter from the mouth end. Dilution and RTD were then checked with various amounts of the tobacco rod removed with the results indicated below. Standard deviation is shown in parenthesis.

| | Column 1 8 holes 12.5 mm | | Column 2 8 holes 22.5 mm | | Column 3 4 holes 12.5 mm 4 holes 22.5 mm | |
|---|---|---|---|---|---|---|
| 0 mm removed | | | | | | |
| RTD (in. $H_2O$) | 3.7 | (.17) | 5.2 | (0.19) | 4.0 | (0.21) |
| Dilution (%) | 62 | (3.8) | 46 | (2.2) | 69 | (3.0) |
| 20 mm removed | | | | | | |

-continued

| | Column 1 8 holes 12.5 mm | | Column 2 8 holes 22.5 mm | | Column 3 4 holes 12.5 mm 4 holes 22.5 mm | |
|---|---|---|---|---|---|---|
| RTD (in. $H_2O$) | 3.6 | (.16) | 5.1 | (0.19) | 4.0 | (0.22) |
| Dilution (%) | 59 | (3.5) | 40 | (2.3) | 64 | (3.6) |
| 40 mm removed | | | | | | |
| RTD (in. $H_2O$) | 3.5 | (0.15) | 4.8 | (0.20) | 3.9 | (0.20) |
| Dilution (%) | 54 | (3.4) | 31 | (1.5) | 57 | (3.6) |
| TPM (mg/cigarette) | 6.3 | | 9.5 | | 6.8 | |

The first column shows RTD and dilution values with inlet vents located at a certain distance from the mouth end of the filter. Column two data shows that moving all the inlet vents away from the mouth end of the filter will increase RTD. However, moving all the inlet vents away from the mouth end also results in a decrease in dilution which is not desirable. Column three data of a cigarette according to the present invention shows that RTD is increased by moving some of the inlet vents away from the mouth end of the filter without significantly reducing the dilution. The experimental data also shows that TPM may also be maintained at a lower level by only moving a portion of the inlet vents away from the filter mouth end. Thus, separating inlet vents into two groups, as taught by the present invention, increases RTD without adversely affecting dilution levels and TPM.

Figure 2:
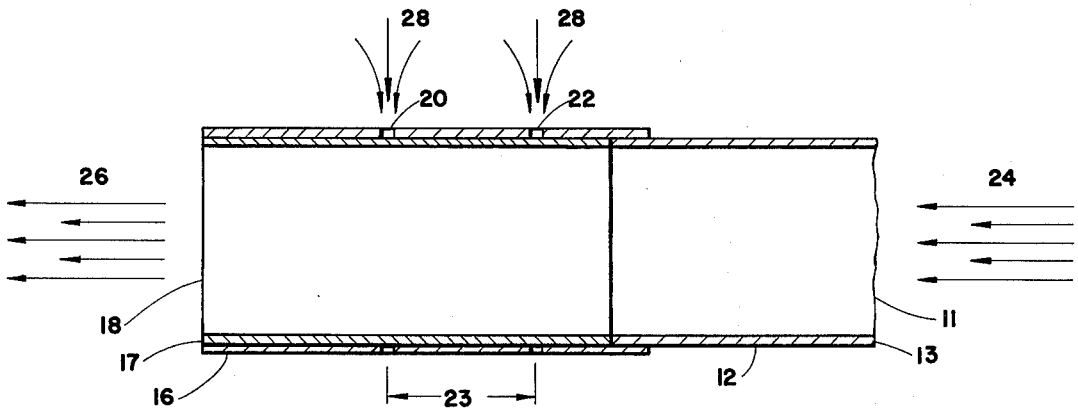
FIG. 2 is a partial longitudinal cross section of the invention shown in FIG. 1.

Referring now to FIG. 2, there is shown a longitudinal cross section of cigarette 10. In the preferred embodiment, tobacco rod 12 consists of a cylinder of tobacco 11, and wrapper 13. Tobacco rod 12 is joined to filter mouthpiece 14 by filter tipping paper 16.

As tobacco smoke 24 is drawn through tobacco cylinder 11 and into filter medium 18, air 28 is drawn into filter medium 18 through inlet vents 20 and 22. Air 28 and tobacco smoke 24 are mixed in filter medium 18, and diluted cigarette smoke 26 is drawn into the smoker's mouth.

It has been found that the inlet vents must be separated by some minimum distance in order to obtain a change in RTD large enough to be perceived by a smoker. A change of three-tenths inch (3/10") $H_2O$, in RTD, was determined to be readily perceived by smokers. To obtain a change in RTD of this magnitude the inlet vent holes must be separated by a distance of 4 to 5 millimeters (mm). However, the minimum separation for the inlet vent holes will depend on whether the cigarette is a low dilution or high dilution cigarette. Inlet vent minimum separation distance is greater on low dilution cigarettes.

It is thus seen that a cigarette according to the present invention will have a higher RTD than conventional cigarettes with an equivalent dilution.

What is claimed as new and desired to be secured by Letters Patent of the United States is:

1. A mouthpiece affording coordinated control of the RTD, dilution and TPM of a cigarette, comprising:

a. a filter medium the outer surface of which is essentially air impervious;

b. inlet vents in said filter medium for admitting outside air for dilution, said inlet vents being in at least two groups, one group located closer to the tobacco end of said mouthpiece and separated from the other group by a distance by a distance effective to increase RTD large enough to be percieved by a smoker without appreciably decreasing dilution and the total particulate matter.

2. A mouthpiece as in claim 1 wherein said inlet vents are divided into two groups, each group arranged in a circumferential band around said mouthpiece.

3. A mouthpiece as in claim 1 wherein on group of said inlet vents is located approximately midway along the length of said mouthpiece, and one group of said inlet vents is located closer to the tobacco end of said mouthpiece.

4. A mouthpiece as in claim 1 wherein said inlet vent groups are separated by at least four millimeters.

5. A mouthpiece as in claim 1 wherein said mouthpiece is attached to a cigarette.

6. A mouthpiece as in claim 2 wherein said mouthpiece is attached to a cigarette.

7. A mouthpiece as in claim 3 wherein said mouthpiece is attached to a cigarette.

8. A mouthpiece as in claim 4 wherein said mouthpiece is attached to a cigarette.

9. The method of making a cigarette mouthpiece effective to achieve a desired RTD level for a given level of TPM and dilution, comprising the steps of:

a. forming filter material into a rod;

c. wrapping said filter material with essentially air impervious material;

d. forming inlet means in said air impervious material to provide preselected dilution level, said inlet means being in two groups, one group separated from the other by a distance by a distance effective to increase RTD large enough to be percieved by a smoker without appreciably decreasing dilution and the total particulate matter.

* * * * *

UNITED STATES PATENT AND TRADEMARK OFFICE

CERTIFICATE OF CORRECTION

PATENT NO. : 4,294,265

DATED : October 13, 1981

INVENTOR(S) : Allen J. Kassman et al.

It is certified that error appears in the above-identified patent and that said Letters Patent is hereby corrected as shown below:

Column 1, line 60, "filter." should be

-- filter efficiency which reduces TPM delivery and results in a loss of flavor. It is therefore an object of the current invention to increase the RTD in a ventilated filter cigarette in such a manner that the dilution level is not decreased and TPM is not decreased. --.

Claim 1, line 9, "by a distance" (second occurrence) should be deleted;

line 10, "percieved" should be -- perceived --.

Claim 9, line 5, "c." should be -- b. --;

line 7, "d." should be -- c. --;

line 10, "by a distance" (second occurrence) should be deleted;

line 11, "percieved" should be -- perceived --.

Signed and Sealed this

*Twenty-ninth* Day of *July 1986*

[SEAL]

*Attest:*

DONALD J. QUIGG

*Attesting Officer* *Commissioner of Patents and Trademarks*